US008695387B2

(12) United States Patent
Keller

(10) Patent No.: US 8,695,387 B2
(45) Date of Patent: Apr. 15, 2014

(54) CLOSING DEVICE

(75) Inventor: Ernst Keller, Richterswil (CH)

(73) Assignee: Assa Abloy (Schweiz) AG, Richterswil (CH)

( * ) Notice: Subject to any disclaimer, the term of this patent is extended or adjusted under 35 U.S.C. 154(b) by 303 days.

(21) Appl. No.: 13/072,417

(22) Filed: Mar. 25, 2011

(65) Prior Publication Data

US 2011/0265529 A1 Nov. 3, 2011

Related U.S. Application Data

(62) Division of application No. 11/911,209, filed as application No. PCT/CH2006/000200 on Apr. 7, 2006.

(30) Foreign Application Priority Data

Apr. 11, 2005 (EP) ..... 05405285

(51) Int. Cl.
*E05B 49/02* (2006.01)
*E05B 27/00* (2006.01)

(52) U.S. Cl.
USPC ..... 70/278.3; 70/278.7; 70/283.1; 70/495; 70/496

(58) Field of Classification Search
USPC ..... 70/278.2, 278.3, 278.7, 279.1, 283.1, 70/419, 421, 491, 495, 496
See application file for complete search history.

(56) References Cited

U.S. PATENT DOCUMENTS

| | | | | |
|---|---|---|---|---|
| 2,391,832 | A * | 12/1945 | Johnstone | 70/367 |
| 3,507,133 | A | 4/1970 | Basseches | |
| 5,211,044 | A * | 5/1993 | Kim | 70/371 |
| 5,517,840 | A | 5/1996 | Haggstrom | |
| 5,542,274 | A | 8/1996 | Thordmark et al. | |
| 5,640,865 | A | 6/1997 | Widen | |
| 5,752,400 | A | 5/1998 | Kim | |
| 5,839,307 | A | 11/1998 | Field et al. | |
| 6,442,986 | B1 | 9/2002 | Russell et al. | |
| 6,477,875 | B2 | 11/2002 | Field et al. | |
| 6,526,791 | B2 | 3/2003 | Shvarts | |
| 6,826,935 | B2 | 12/2004 | Gokcebay et al. | |
| 7,140,214 | B2 | 11/2006 | Lindstrom | |
| 2003/0062985 | A1 | 4/2003 | Luo | |
| 2005/0235714 | A1 | 10/2005 | Lindstrom | |

FOREIGN PATENT DOCUMENTS

| | | | |
|---|---|---|---|
| EP | 1 031 685 | A1 | 8/2000 |
| EP | 1 205 616 | A2 | 5/2005 |
| FR | 2 808 552 | A1 | 11/2001 |
| WO | 88/05106 | | 7/1988 |
| WO | 03/085227 | A1 | 10/2003 |
| WO | 03/104589 | A1 | 12/2003 |

* cited by examiner

*Primary Examiner* — Christopher Boswell
(74) *Attorney, Agent, or Firm* — Browdy and Neimark, PLLC

(57) ABSTRACT

The invention relates to a closing device which includes a stationary part and a part which is displaceably mounted thereon. Tumblers are arranged by means of a key in order to release the displaceable part. These tumblers are maintained in a locking position by means of the locking element. The locking element can be adjusted by means of a drive in order to release the tumblers, which can be controlled via an electronic control device.

11 Claims, 6 Drawing Sheets

CLOSING DEVICE

Figure 1:
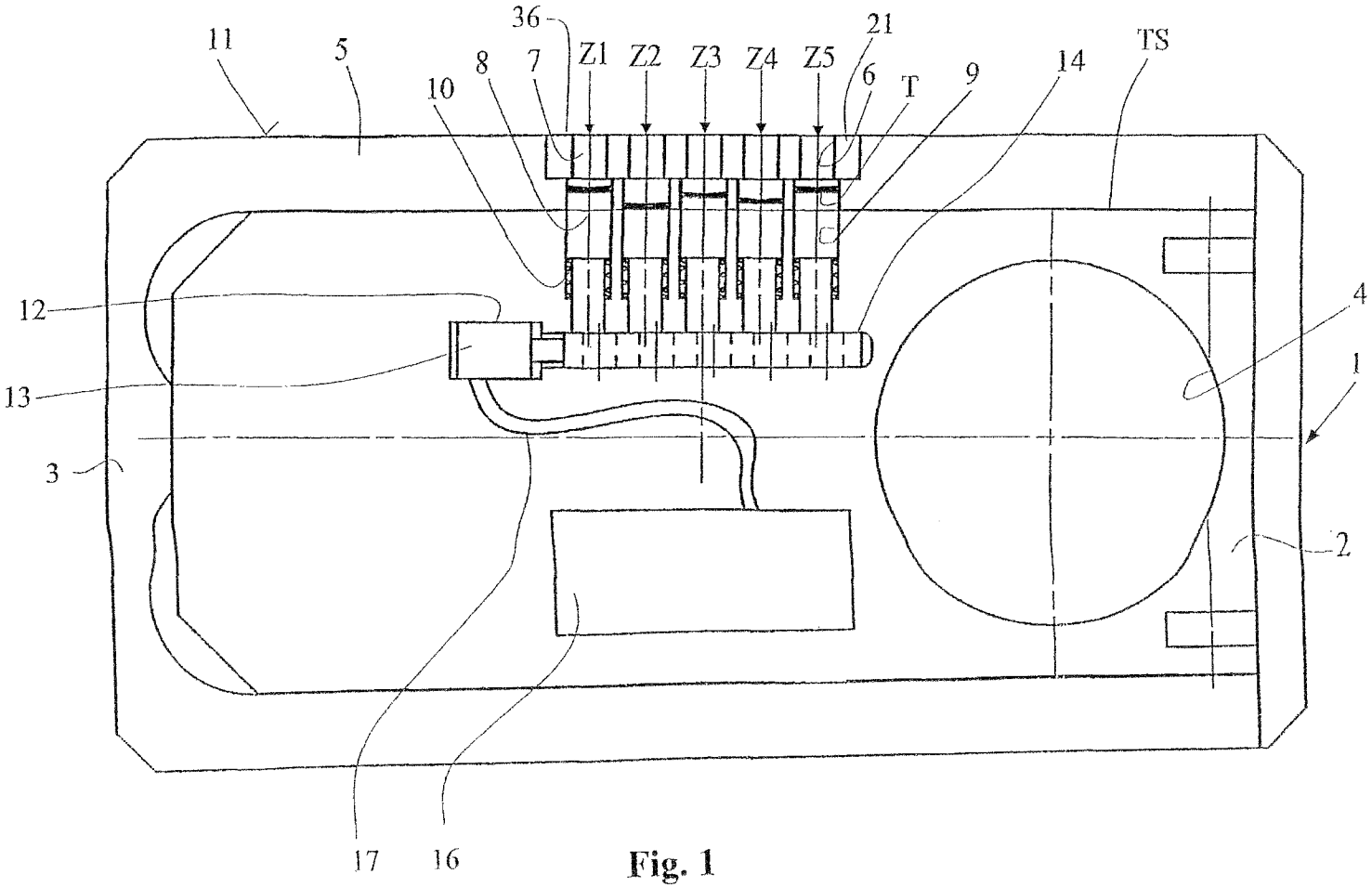

The invention relates to a closing device comprising a fixed part and a thereon mounted moving part, having tumblers, which, for the release of the moving part, have to be aligned by the use of a key.

A closing apparatus of this type has become known from WO 03/104589. This is configured as a covering device and has a cover plate which is mounted displaceably between a first and a second setting. In the second setting, an actuating member, for example a closing cylinder, is released. For the locking of the cover plate, tumblers are provided, which have to be aligned by the use of a key. In the embodiment shown in FIG. 10, a pin is provided, which in the locked state engages in a bore of the cover plate. This pin is displaceable with a motor into a setting in which the cover plate is unlocked. The motor is powered by a battery and can be activated contactlessly.

The object of the invention is to provide a closing device of the said type which ensures a still higher security.

The object is achieved by the fact that the tumblers are held with a blocking element in a blocking position, and the blocking element, for the release of the tumblers, is adjustable with a drive mechanism which can be activated via an electronic control device.

In the closing device according to the invention, the tumblers can only be aligned once these have been unblocked by adjustment of the blocking element. The unblocking is realized by activation of the drive mechanism. This drive mechanism is, for example, a micromotor, which can be activated contactlessly. The code for activating the micromotor is stored, for example, in a transponder, which is disposed in the fixed part of the control device. The key is preferably a mechatronic key, which has, on the one hand, control surfaces for the alignment of the tumblers and, on the other hand, a chip with which the motor can be activated via a corresponding signal. To enable the release of the moving part and, in particular, of a cover plate or the like, the motor must first be activated and then the tumblers must be aligned.

According to one refinement of the invention, the tumblers in the locked state lie respectively on an outer surface flush with an outer surface of the moving part. This has the fundamental advantage that, on the one hand, these tumblers, with regard to a possible act of vandalism, are not readily recognizable and are less vulnerable in terms of their functioning.

According to one refinement of the invention, the blocking element is configured as a slide or bolt and has recesses which, in the unlocked state, can receive pins of the tumblers. This blocking element is preferably displaced with a suitable motor directly between the locking and the releasing position. Preferably, the blocking element is displaceably mounted in a recess, in particular in a slot of the fixed part.

According to one refinement of the invention, the blocking element is displaceable in the longitudinal direction of the tumblers, for example with an eccentric. According to one refinement, the displacement is realized by an eccentric cam, which engages in a slot of the blocking element. According to one refinement of the invention, two eccentric rollers are provided, which act upon the blocking element.

The control device according to the invention is disposed, in particular, in a covering device, but other applications, too, are conceivable.

Further advantageous features emerge from the dependent patent claims, the following description and the drawing.

Figure 2:
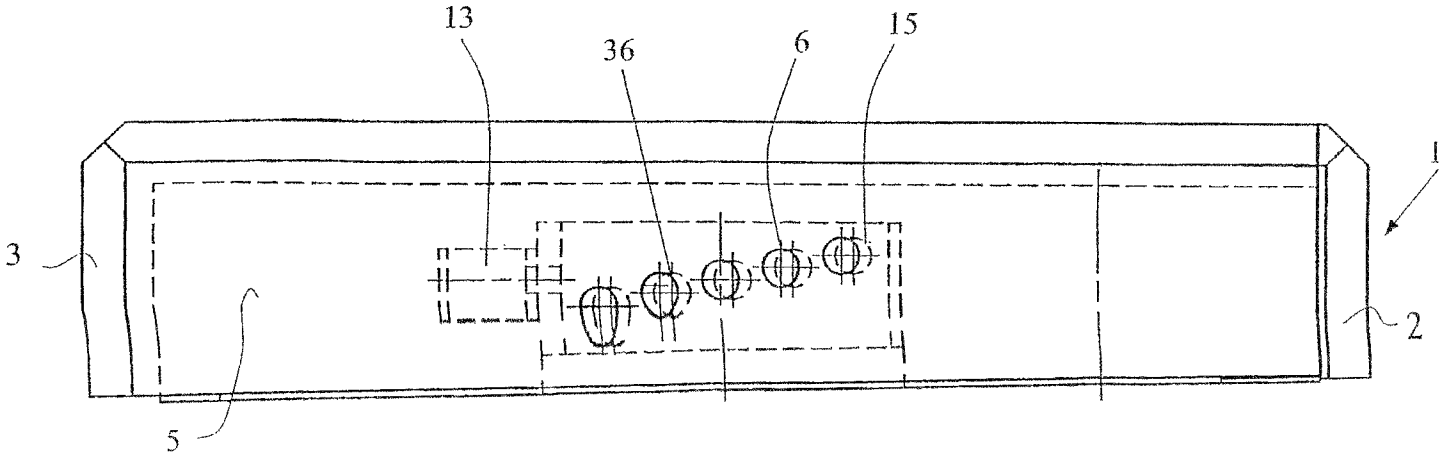
Figure 3:
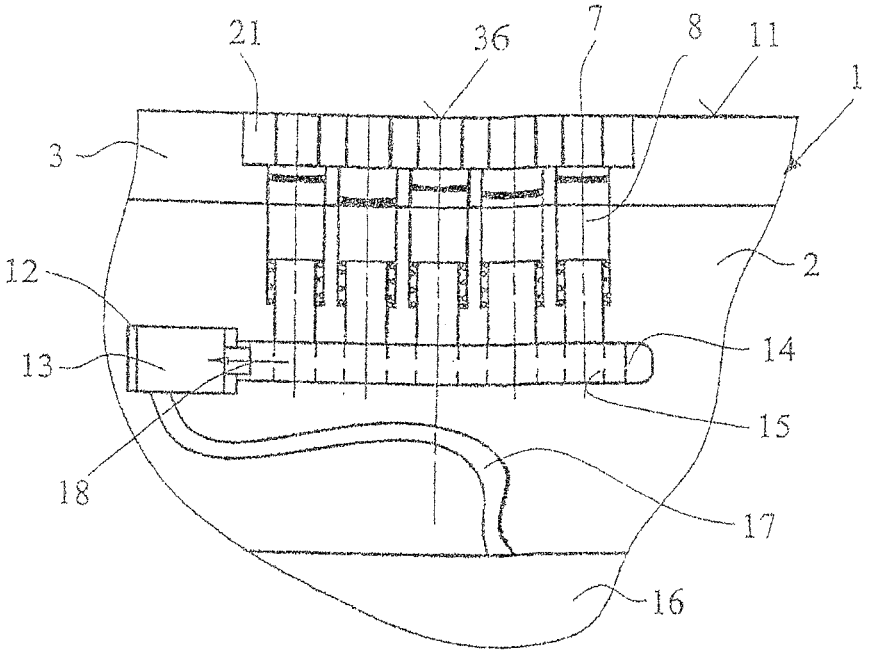
Figure 4:
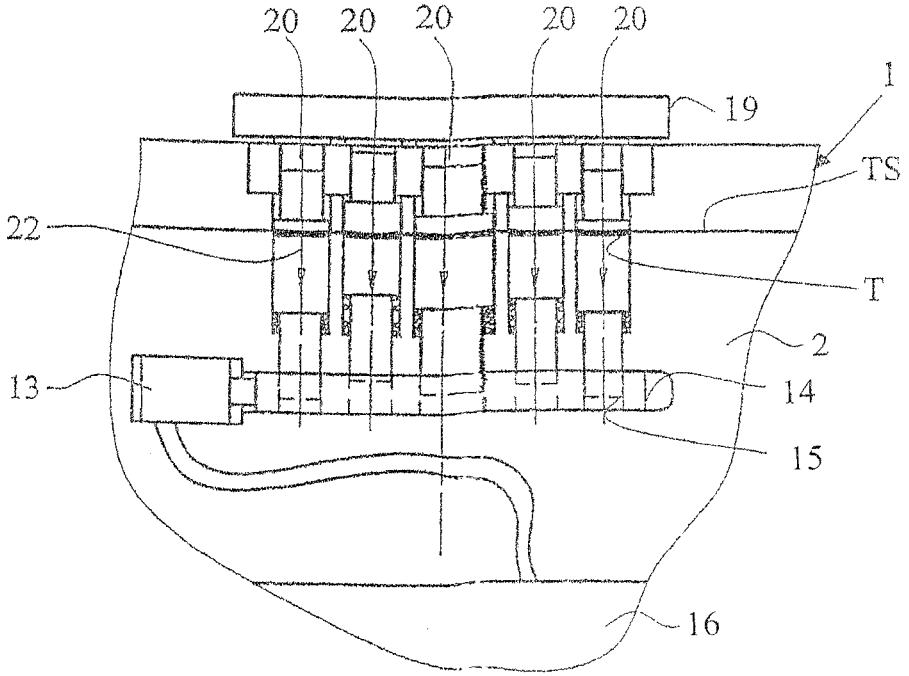
Figure 5:
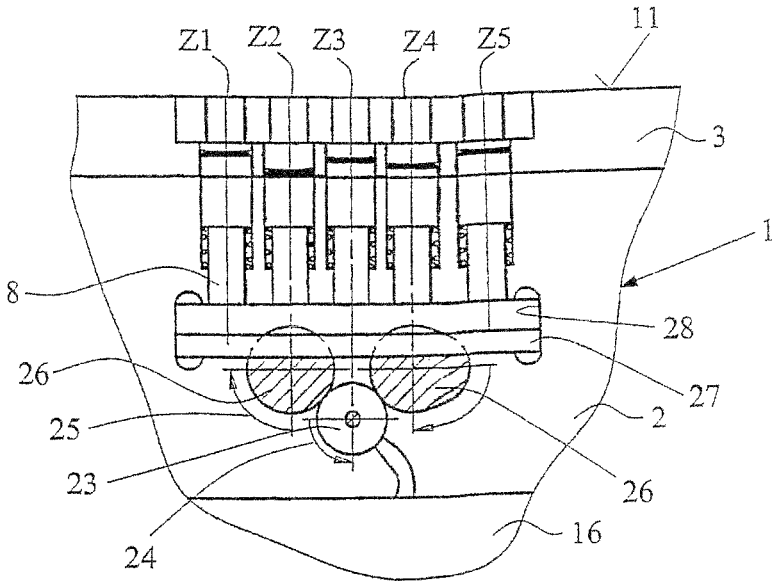
Figure 6:
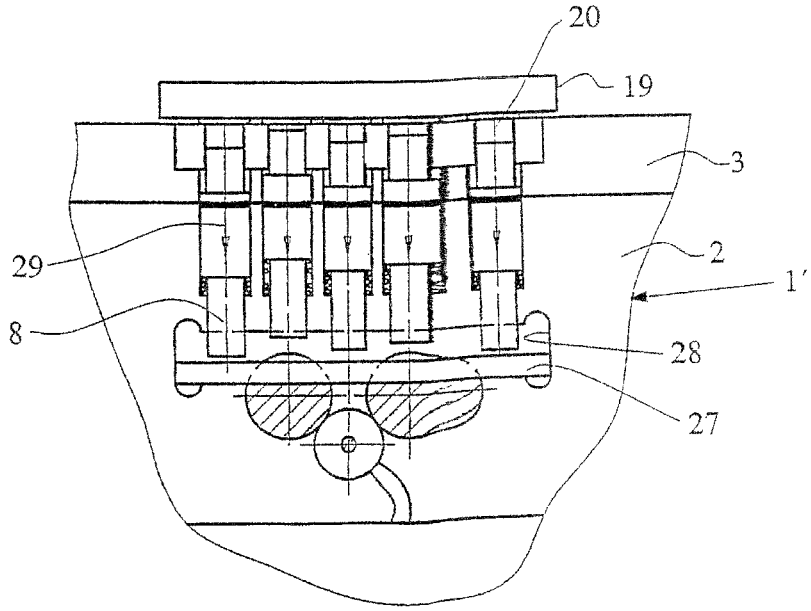
Figure 7:
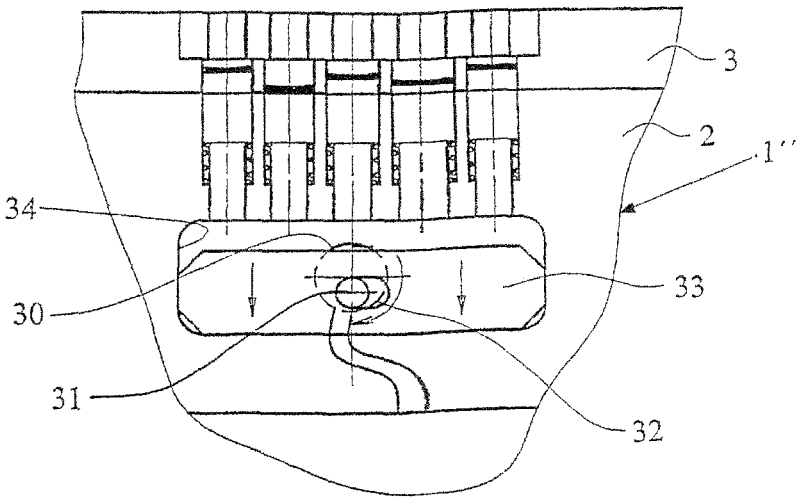
Figure 8:
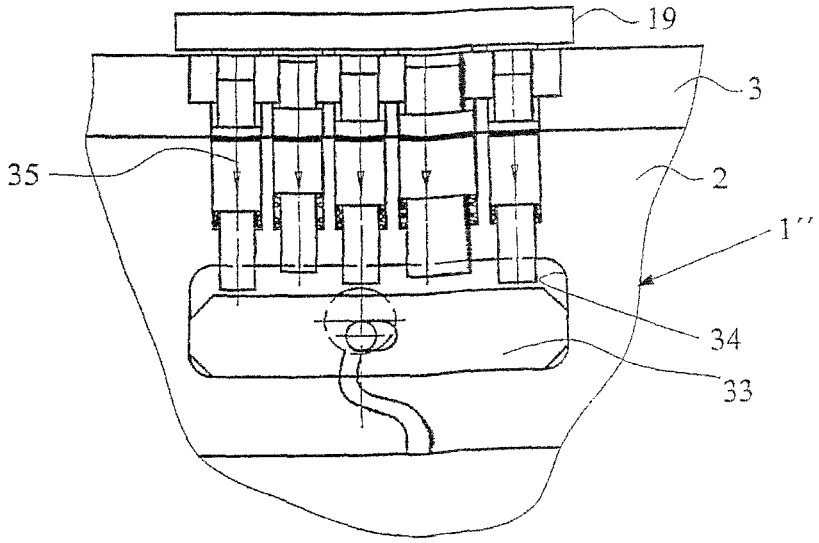
Figure 9:
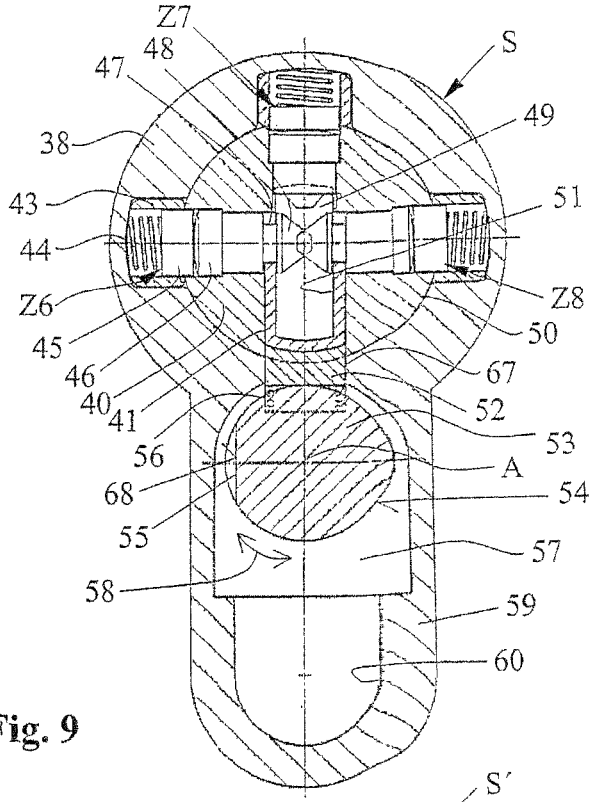
Figure 10:
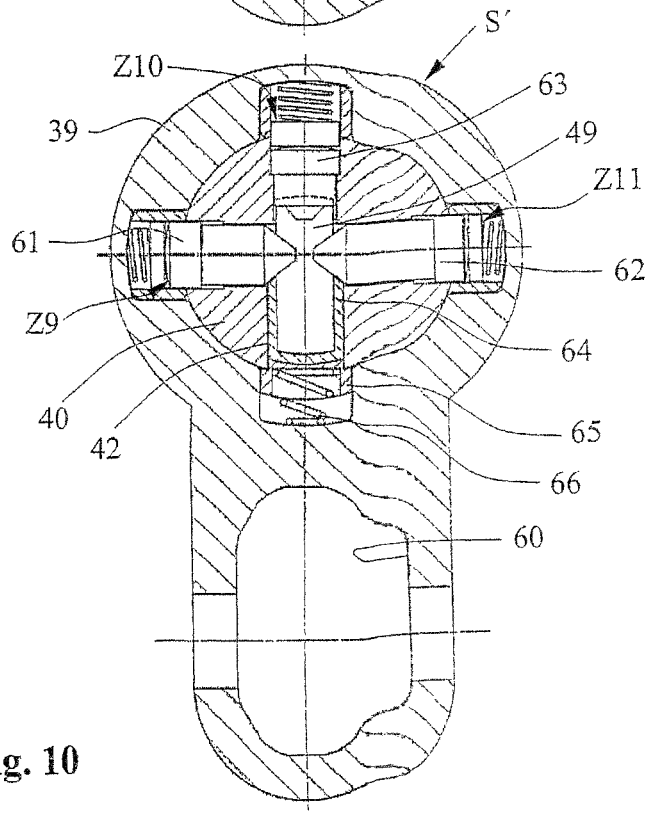

Illustrative embodiments of the invention are explained in greater detail below with reference to the drawing, wherein:

FIG. 1 shows in diagrammatic representation a view of the rear side of a closing device according to the invention, FIG. 2 shows a view of a narrow side of the closing device according to the invention, FIG. 3 shows in diagrammatic representation a part-section through the closing device, tumblers being in the blocking position, FIG. 4 shows a section according to FIG. 3, the tumblers being aligned, FIG. 5 shows a part-section through a closing device according to the invention according to one variant, FIG. 6 shows a section according to FIG. 5, yet in which the tumblers are aligned, FIG. 7 shows a section through a closing device according to a further variant, FIG. 8 shows a section according to FIG. 7, the tumblers in this case being aligned, FIG. 9 shows a section through a closing device according to one variant, and FIG. 10 shows a section through a closing device according to a further variant.

FIG. 1 shows a closing device 1, which has a housing as a fixed part, which latter is disposed, for example, on a box, for example on an electronics box. The housing 2 possesses a circular recess 4 for the reception of a closing cylinder (not shown here). On the housing 2 there is displaceably mounted a slide 3, which is, in particular, a cover plate. In the position shown in FIG. 1, the slide 3 covers the opening 4 and hence the closing cylinder projecting into said opening. The closing cylinder is thus inaccessible and is secured against attack.

The slide 3 is secured in the closing position by tumblers Z1-Z5. In the embodiments which are shown here, five tumblers are provided, but more or less tumblers may also be provided. According to FIG. 2, the tumblers Z1-Z5 are disposed essentially in a line. They respectively comprise an outer pin 7, an inner pin 8 and a spring 10, which loads the inner pin 8 in the radially outward direction. Between the outer pin 7 and the inner pin 8 there exists, in each case, a separation plane T, which lies respectively in the region of the slide 3. The inner pins 8 respectively cross a separation plane TS between the housing 2 and the slide 3. The slide 3 is thus locked relative to the housing 2 by the inner pins 8. The inner pins 8 are step pins and are mounted respectively in a bore 9 of the housing 2. The outer pins 7 are located in corresponding bores of the slide 3 and project respectively into a bore 6. The bores 6 are sunk into a plate-shaped insert 21, which is inserted in a corresponding recess of the slide 3. The bores 6 may also, however, be sunk directly into the slide 3.

The outer pins 7 respectively have an outer surface 36, which lies flush with an outer surface 11 of the slide 3. This outer surface 11 is preferably disposed on a narrow side of the slide 3. This narrow side is visible in FIG. 2.

The tumblers Z1-Z5 are blocked by a blocking element 14. This blocking element 14 is configured as a slide or bolt and, according to FIG. 1, is displaceably mounted in a recess 12 of the housing 2. In the shown setting, the inner pins 8 bear with a front surface 37 against the blocking element 14. In this position of the blocking element 14, therefore, the tumblers Z1 and Z5 cannot be moved.

In order to release the tumblers Z1-Z5, the blocking element 14 can be displaced to the left into the position shown in FIG. 3. This movement is indicated in FIG. 3 with the arrow 18. In this position, bores 15 of the blocking element 14 are positioned such that the inner pins 8 can engage in these bores 15. In order to bring the blocking element 14 into this position, a motor 13 is provided, which is likewise mounted in the housing 2 in the recess 12 and which, for example, is powered with a battery (not shown here) and can be activated via a line 17. The actuation of the motor 13 is realized via an electronics unit 16, which is known per se and in which an appropriate code is stored.

Once the blocking element 14 is displaced into the position shown in FIG. 3, then the tumblers Z1-Z5 can be aligned by the use of a key 19. A key suitable for this purpose is disclosed in the above-stated WO 03/104589. The key 19 possesses pins 20, which are likewise disposed in a row and which can be introduced into the bores 6. The pins 20 are different in length, to be precise such that the tumblers Z1-Z5 can be aligned. In the aligned state, the above-stated separation planes T are located in the separation plane TS.

In FIG. 4, the tumblers Z1-Z5 are shown in the aligned setting. The slide 3 is thus free and can in FIG. 4 be displaced to the left until the opening 4, or the closing cylinder disposed therein, is freely accessible. The closing cylinder can be a standard closing cylinder, which has a key channel into which, for the release of the closing cylinder, the shank (not shown) of the key 19 can be introduced. This shank has, for example, bores having control surfaces with which the tumblers of the closing cylinder can be aligned. In this case, the key 19 thus possesses three closing codes, a first for the activation of the motor 13, a second for the alignment of the tumblers Z1-Z5 and a third for the alignment of the closing cylinder.

FIGS. 5 and 6 show a closing device 1', which likewise has tumblers Z1 to Z5. For the locking of these tumblers Z1-Z5, a blocking element 27 is provided, which is displaceable in a recess 28. For the displacement of the blocking element 27, two eccentrics are provided, which are driven by a motor 23. In FIG. 5, the blocking element 27 is shown in a setting in which the tumblers Z1-Z5 are free. If the eccentrics 26 are rotated respectively according to the arrow 25 through 180°, then the blocking element 27 is displaced upward until it bears against the inner pins 8. The tumblers Z1-Z5 are then locked. In order to displace the eccentrics 26, a roller of the motor 23 is rotated according to the arrow 24 in the opposite direction. The engagement of the motor 23 on the eccentrics 26 is realized by friction or by interlocking teeth (not shown here). The motor 23 is activated contactlessly, like the motor 13, via a suitable control system.

If the tumblers Z1-Z5 of the closing device 1' are unlocked, then these, for the release of the slide 3, are likewise aligned by the use of the key 19. The tumblers Z1-Z5 are hereupon displaced, according to FIG. 6, in the directions of the arrows 29. As can be seen, the inner pins 8 here respectively engage with a front end in the recess 28.

FIGS. 7 and 8 show a closing device 1", in which a blocking element 33 is provided which, similarly to the blocking element 27, is displaceable between two positions. The blocking element 33 is mounted in a recess 34 and possesses a slot 32, in which an eccentric cam 31 engages. Through the rotation of the cam 31 with a motor 30, the blocking element 33 is displaced. FIGS. 7 and 8 show the blocking element 33 respectively in the unblocked position. In FIG. 8, the tumblers Z1-Z5 are aligned by virtue of the key 19. The activation of the motor 30 is here realized as explained above.

FIG. 9 shows in section a closing cylinder S for a safety lock, which, in a manner which is known per se, has a stator 38 in which a rotor 40 is mounted. This rotor possesses tumblers Z6, Z7 and Z8, which respectively have a compression spring 44, a housing pin 45 and a core pin 46. The springs 44 and the housing pins 45 are respectively mounted in a known manner in slides 43. The core pins 46 of the tumblers Z6 and Z8 respectively possess a tip 48, which tips project into a key channel 49 and cooperate with control surfaces of a flat key (not shown here). The core pins 46 of these tumblers Z6 and Z8 respectively possess behind the tip 48 a circumferential groove 47. Engaging from below in these two grooves 47 is a blocking element 41, which is inserted in the key channel 49. The blocking element 41 of U-shaped cross section possesses a recess 51 for the reception of the key shank, which has to be inserted into the key channel 49 for the release of the rotor 40.

The blocking element 41 bears against a locking element 52, which, as can be seen, likewise projects into the lock channel 49. The locking element 52 additionally extends into a recess 67 of the stator 38 and bears against a switching member 53, which is rotatably mounted in a support 57. This support 57 is located in a recess 60 of a cylinder sack 59. A compression spring is supported against the switching member 53 and tensions the locking element 52 against the blocking element 41. As a result of this tension, the blocking element 41 is held in the setting shown in FIG. 9.

The switching member 53 possesses a cylindrical outer side 54 and a recess 55 having a bearing surface 68.

The switching member 53 can be rotated with a motor (not shown here), for example an electric motor mounted in the cylinder sack 59, in the directions of the double arrow 58 about an axis A. If the switching member 53 is in the position shown in FIG. 9, then the locking element 52 bears against the outer side 54 and, according to FIG. 9, can be moved neither upward nor downward. If the switching member 53, in FIG. 9, is now rotated clockwise through 90°, then the recess 55 is located beneath the locking element 52. If now, in this rotational position of the switching member 53, a key is inserted into the key channel 49, then the blocking element 41 is moved downward counter to the reactive force of the spring 56. As a result of this movement, the locking element 52 is moved downward in the same direction and by the same amount, whereupon it engages in the recess 55. As a result of this movement, on the one hand, the locking of the rotor 40 by the locking element 52 and, on the other hand, the locking of the core pins 46 by the blocking element 41, is cancelled. The rotor 40 and the two core pins 46 of the tumblers Z6 and Z8 are unlocked and thus the tumblers Z6, Z7 and Z8 can be aligned by the key and the rotor 40 can be rotated so as to actuate the lock. If the key is withdrawn, then, as a result of the tension of the spring 56, the locking element 52 and the blocking element 41 are moved back into the upper setting shown in FIG. 9. If the switching member 53 is now moved counterclockwise through 90° into the rotational position shown in FIG. 9, then the rotor 40 and the core pins 46 of the tumblers Z1 and Z8 are locked again. In this locked position, said core pins 46 can be moved neither inward nor outward. Moreover, the rotor 40 is locked by the locking element 52 to the stator 38. The movement of the switching member 53 between said two positions is realized, as mentioned, with a motor (not shown here). This motor is controlled by a control device (not shown here). The control can also be realized contactlessly.

FIG. 10 shows a closing cylinder S', of the tumblers Z9, Z10 and Z11. The closing cylinder S' likewise possesses a stator 39 and a rotor 40 having a key channel 49. Inserted in the key channel 49 is a blocking element 42, which with upper edges 64 bears against core pins 61 and 62 of the tumblers Z9 and Z11 and thereby locks these two core pins 61 in the outward direction in the shown blocking position. The core pins 61 and 62 respectively cross the shear plane 50 between the rotor 40 and the stator 38, so that the rotor 40 cannot be rotated. Further tumblers 63 can be of intrinsically standard configuration. The blocking element 42 bears against a locking element 65, which locks the rotor 40 relative to the stator 39 in the shown position. As explained with reference to FIG. 9, the locking element 65 cooperates with a switching member 53 (not shown here). The locking element 65 can thus deflect immovably or movably in the downward direction. If the locking element 65 is immovable, then the blocking element 42 can correspondingly also not be moved. The core pins 61 and 62 can correspondingly also not be moved inward and it is thus not possible to release the rotor 40. If the switching member 53 is in a position in which the locking element 65 can be moved downward counter to the reactive force of a spring 66, when a key (not shown here) is introduced into the key channel 49, the blocking element 42 can be moved downward and hence the two core pins 61 and 62 unlocked. When the key is withdrawn, the blocking element 42 and the locking element 65 are moved upward by the spring 66 into the position shown in FIG. 10. Through a corresponding rotational movement of the switching member 53, the locking element 65 is fixed again.

| Reference symbol list | |
|---|---|
| 1 | closing device |
| 1' | closing device |
| 1" | closing device |
| 2 | housing |
| 3 | slide |
| 4 | opening |
| 5 | side wall |
| 6 | bore |
| 7 | outer pin |
| 8 | inner pin |
| 9 | bore |
| 10 | spring |
| 11 | surface |
| 12 | recess |
| 13 | motor |
| 14 | blocking element |
| 15 | bore |
| 16 | electronics unit |
| 17 | lines |
| 18 | arrow |
| 19 | key |
| 20 | pin |
| 21 | insert |
| 22 | arrow |
| 23 | motor |
| 24 | arrow |
| 25 | arrow |
| 26 | eccentric |
| 27 | blocking element |
| 28 | recess |
| 29 | arrow |
| 30 | motor |
| 31 | eccentric cam |
| 32 | slot |
| 33 | blocking element |
| 34 | recess |
| 35 | arrow |
| 36 | outer surface |
| 37 | front surface |
| 38 | stator |
| 39 | stator |
| 40 | rotor |
| 41 | blocking element |
| 42 | blocking element |
| 43 | slide |
| 44 | spring |
| 45 | housing pin |
| 46 | core pin |
| 47 | groove |
| 48 | tip |
| 49 | key channel |
| 50 | shear plane |
| 51 | recess |
| 52 | locking element |

-continued

| Reference symbol list | |
|---|---|
| 53 | switching member |
| 54 | peripheral surface |
| 55 | recess |
| 56 | spring |
| 57 | support |
| 58 | double arrow |
| 59 | cylinder sack |
| 60 | recess |
| 61 | core pin |
| 62 | core pin |
| 63 | core pin |
| 64 | edge |
| 65 | locking element |
| 66 | spring |
| 67 | recess |
| 68 | bearing surface |
| A | axis |
| S | closing cylinder |
| S' | closing cylinder |
| T | separation plane |
| TS | separation plane |
| Z1 | tumbler |
| Z2 | tumbler |
| Z3 | tumbler |
| Z4 | tumbler |
| Z5 | tumbler |
| Z6 | tumbler |
| Z7 | tumbler |
| Z8 | tumbler |
| Z9 | tumbler |
| Z10 | tumbler |
| Z11 | tumbler |

The invention claimed is:

1. A closing device comprising:

a fixed part; and a moving part mounted on the fixed part, the moving part having tumblers, which, for the release of the moving part, have to be aligned by the use of a key, a blocking element holding the tumblers in a blocking position, a drive mechanism for adjusting the blocking element, for the release of the tumblers, an electronic control device for activating the drive mechanism, wherein the moving part comprises a rotor rotatably arranged inside the fixed part, wherein the rotor comprises a key channel into which the blocking element is inserted to block more than one tumbler inside the key channel, wherein the blocking element is configured to be displaced to unlock the tumblers by insertion of the key into the key channel of the rotor, wherein the blocking element is of U-shaped cross section and possesses a recess for the reception of key shank of the key, which has to be inserted into the key channel for the release of the rotor, and wherein said tumblers are arranged on both sides of said key channel.

2. The closing device as claimed in claim 1, wherein the tumblers respectively have a core pin, which core pins, in the locked state, bear against said blocking element.

3. The closing device as claimed in claim 1, further comprising a motor for displacing the blocking element directly between two positions.

4. The closing device as claimed in claim 1, wherein said blocking element, for the unlocking of the tumblers, can be moved away from the tumblers.

5. The closing device as claimed in claim 4, further comprising an eccentric for displacing said blocking element.

6. The closing device as claimed in claim 1, further comprising a locking element to block the rotor.

7. The closing device as claimed in claim 6, wherein the locking element is configured to cooperate with the blocking element.

8. The closing device according to claim 1, further comprising a locking element projecting into the key channel, the blocking element being configured to bear against the locking element.

9. The closing device according to claim 8, wherein the tumblers comprise core pins, and the blocking element comprises upper edges which bear against the core pins and thereby locks the core pins.

10. The closing device according to claim 8, further comprising a switching member that cooperates with the locking element.

11. The closing device according to claim 10, further comprising a motor for rotating the switching member.

* * * * *